United States Patent [19]

Braley et al.

[11] 3,961,500

[45] June 8, 1976

[54] YARN RUNNER-LENGTH CONTROLLER FOR KNITTING MACHINES

[75] Inventors: Robert L. Braley, Thomaston; Mircea Tenenbaum, Hamden; Edward J. Milano, Bristol, all of Conn.

[73] Assignee: Gould Inc., Chicago, Ill.

[22] Filed: Oct. 15, 1974

[21] Appl. No.: 514,812

[52] U.S. Cl. ..... 66/210; 235/150.1; 235/92 DN

[51] Int. Cl.[2] ..... D04B 23/00; D04B 27/00

[58] Field of Search ..... 66/86 H, 86 L; 139/105, 139/110; 235/151.13, 151.32, 92 PD, 92 CT, 92 DN; 318/6, 326, 327; 242/75.51

[56] References Cited

UNITED STATES PATENTS

| | | | |
|---|---|---|---|
| 2,674,109 | 4/1954 | Bassist | 66/86 L |
| 3,223,906 | 12/1965 | Dinger | 242/75.51 |
| 3,626,725 | 12/1971 | Fertig et al. | 66/86 L |
| 3,630,052 | 12/1971 | Fertig et al. | 66/86 L |
| 3,668,904 | 6/1972 | Murenbeeld | 66/86 L |
| 3,673,473 | 6/1972 | Werner | 242/75.51 |
| 3,727,033 | 4/1973 | Bassist | 66/86 L |
| 3,749,329 | 7/1973 | Nedreski | 318/6 |
| 3,764,876 | 10/1973 | Arthur | 318/326 |
| 3,858,415 | 1/1975 | Wilson et al. | 66/86 H |

*Primary Examiner*—Ronald Feldbaum
*Attorney, Agent, or Firm*—Mattern, Ware, Davis & Stoltz

[57] ABSTRACT

A yarn runner-length controller for warp beam knitting machines utilizes information of the yarn unwinding rate from a warp beam section and continuously compares this information to a signal related to the desired runner-length of the yarn. This continuous comparison yields an error signal with a magnitude proportional to the difference between the desired runner-length and the actual runner-length. The error signal is sampled and this sampled error signal activates a control device operating on the angular velocity of the warp beam section so as to adjust this velocity in the direction that reduces the difference between the actual runner-length and the desired runner-length. The magnitude of the sampled error signal is reduced to zero before the next sampled error signal is received by means of a signal from the control device related to the amount of adjustment made to the beam section's angular velocity. When the sampled error signal is reduced to zero, the control device maintains the beam section's angular velocity to the last adjusted value. The continued sampling of the error signal thus maintains the actual runner-length to within close tolerances of the desired runner-length throughout the duration of the knitting process.

An error display panel indicates any deviation between the actual and desired runner-lengths. A fail-safe module shuts down the knitting machine if the deviation between the actual and desired runner-lengths is greater than a predetermined amount.

In addition, data acquisition means are included which can monitor such conditions as actual and desired runner-lengths, error between actual and desired runner-lengths, number of knitting interruptions, and duration of knitting interruptions.

48 Claims, 8 Drawing Figures

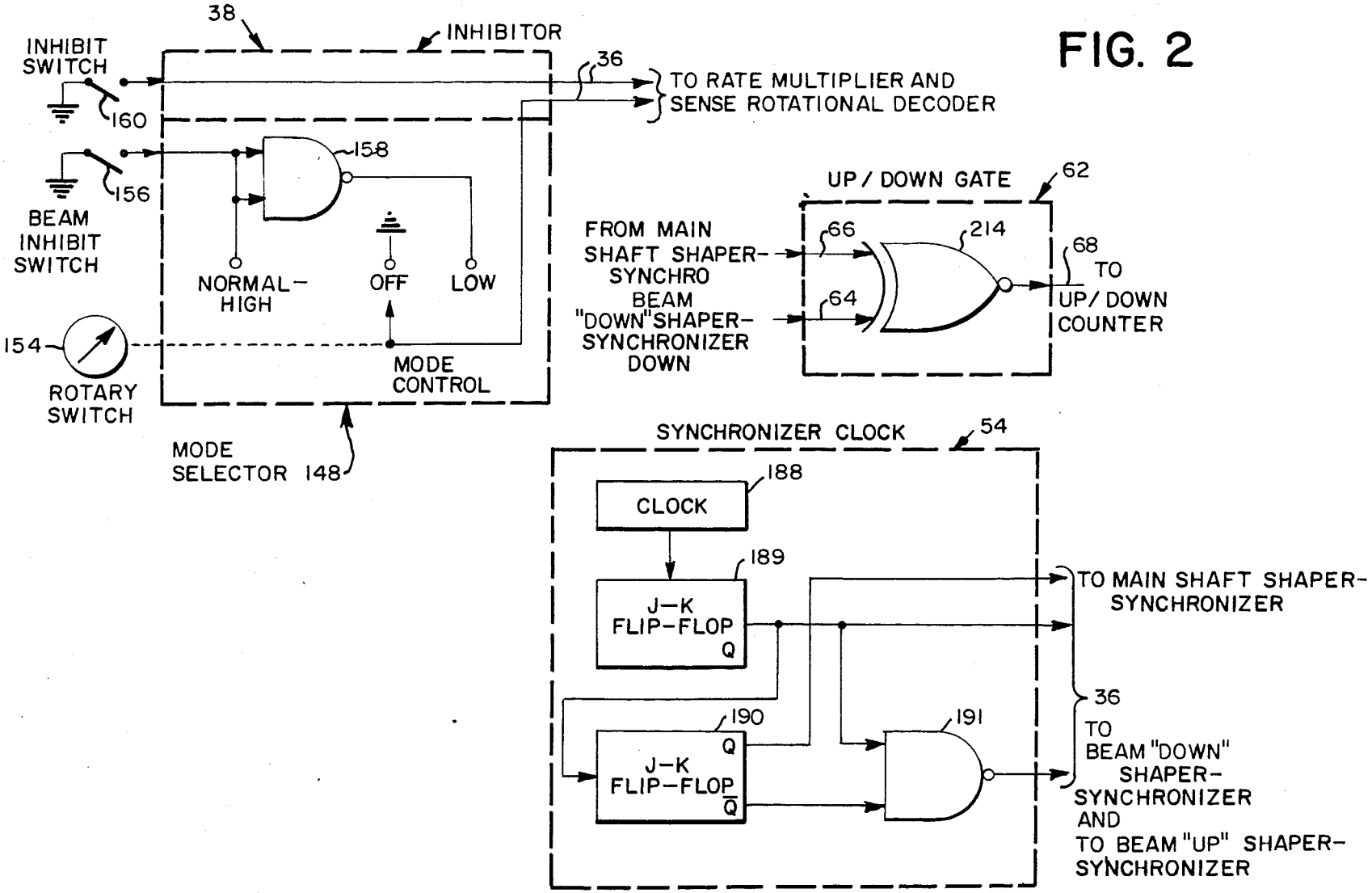
FIG. 2
INHIBITOR
38
36
TO RATE MULTIPLIER AND SENSE ROTATIONAL DECODER
158
NORMAL-HIGH
OFF
LOW
MODE CONTROL
MODE SELECTOR 148
INHIBIT SWITCH
160
BEAM INHIBIT SWITCH
156
ROTARY SWITCH
154
62
UP/DOWN GATE
214
66
64
68
TO UP/DOWN COUNTER
FROM MAIN SHAFT SHAPER-SYNCHRO
BEAM "DOWN" SHAPER-SYNCHRONIZER DOWN
54
SYNCHRONIZER CLOCK
188
CLOCK
189
J-K FLIP-FLOP
Q
190
J-K FLIP-FLOP
Q
Q̄
191
TO MAIN SHAFT SHAPER-SYNCHRONIZER
36
TO BEAM "DOWN" SHAPER-SYNCHRONIZER AND TO BEAM "UP" SHAPER-SYNCHRONIZER SWITCH DISPLAY
MAIN SHAFT SHAPER-SYNCHRONIZER
BCD SWITCH
RATE MULTIPLIER
J-K FLIP-FLOP
FROM SYNCHRONIZER CLOCK
RESET LINE
TO RUNNER-LENGTH COUNTER
BCD SWITCHES 30
RATE MULTIPLIER
MAIN SHAFT TACHOMETER
INHIBIT
MODE CONTROL
TO UP DOWN GATE
56
34
28
26
22
36
66
129
162
163
164
165
166
168
169
170
171
172
173
193
194
195
196
197
198

YARN RUNNER-LENGTH CONTROLLER FOR KNITTING MACHINES

BACKGROUND OF THE INVENTION

The present invention relates to an apparatus for controlling the length of yarn used by a warp beam knitting machine to produce one rack of knitted fabric.

Warp beam knitting machines incorporate warp beam sections, each section comprising a multiplicity of yarns wound about it. These yarns, forming a yarn sheet, are unwound from the beam section to needle bars where the fabric is knitted. The knitted fabric is accumulated on take-up rolls for later use. The unwinding rate of the yarns delivered to the needle bars is directly proportional to the instantaneous angular velocity of the warp beam section and the instantaneous radii of the yarns about the beam section. Therefore as yarns are unwound from the beam section a constant unwinding rate is obtainable by continuously adjusting the angular velocity of the beam section.

The fabric produced by the warp beam knitting machines consists of rows of loops or stitches, each row being called a course. One course is produced for each revolution of the main shaft of the knitting machine. By definition, a rack of knitted fabric is the length of knitted fabric incorporating 480 courses, which therefore equals 480 revolutions of the main shaft. In addition, a runner-length is defined as the length of yarn unwound from a beam section when one rack of fabric is knitted.

Thus, in order to obtain a uniform rack of knitted fabric, it is necessary that the runner-length of the unwound yarns be held to within very close tolerances. In a typical situation where the runner-length is 60 inches, a deviation of even one inch will produce unacceptable knitted fabric due to puckering, i.e., wrinkling of the normally smooth fabric surface, or due to distortions in the pattern design of the fabric. Thus, if a diamond shaped pattern was sought in the knitted fabric, a wrinkled and distorted diamond pattern would occur. Such wrinkles, distortions, and lack of uniformity in the knitted fabric are, of course, undesirable. In addition, such errors in the runner-length result in increased tension on the yarn filaments which can cause the knitting needles to break.

Warp beam knitting machines presently relay on mechanical devices to regulate the unwinding rate of the yarn and thus the runner-length of the yarn. In particular, these devices:

1. mechanically measure the unwinding rate of the yarn;
2. mechanically transfer this information by means of a chain and sprocket to a regulating spindle where the information is compared to a constant (control) speed worm wheel that monitors the main shaft's angular velocity.
3. mechanically activate a pawl that allows a ratchet wheel to move one position when a difference in angular velocity between the spindle and worm wheel occurs;
4. the ratchet wheel turning a micrometer thread spindle that axially moves a friction ring mounted on a cone driven by the main shaft;
5. a second cone making contact with the friction ring being turned at a faster or slower rate depending upon the axial position of the friction ring; and
6. the driven cone turning the warp beam section and thus adjusting the beam section's angular velocity.

Due to the various mechanical linkages in this device, there is a large time lag between measuring the beam section's unwinding rate and adjusting the friction ring to correct for any change in the unwinding rate. This inherent sluggishness of the present-day controllers therefore allows an undesirable unwinding rate of yarn to exist for a relatively long period of time and thereby produces knitted fabric with nonuniform course density. Also, since the unwinding rate adjustment is relatively coarse, the adjustment inherently overshoots or undershoots the desired unwinding rate and consequently causes the actual unwinding rate to oscillate between two values that bracket the desired unwinding rate. This relatively large oscillating variation of the actual unwinding rate causes the knitted fabric to have noticeable puckering where each change in unwinding rate occurs. Thus, a rack of knitted fabric produced by a knitting machine using present-day controllers has neither the desired course density — i.e., uses an undesired runner-length of yarn — nor a uniform course density.

Furthermore, present-day controllers inherently drift from the desired runner-length which necessitates that the operator periodically shut down the knitting machine in order to measure the actual runner-length and make manual adjustment to the driven cone position. Such stoppages further reduce the productivity of knitting machines.

The present invention is able to eliminate the above-mentioned undesirable characteristics of present-day controllers. In particular, the time lag between the sensed change in the yarn unwinding rate and the corresponding control of the beam section's angular velocity is greatly reduced by elminiating the mechanical linkages found in present-day controllers. By removing the pawls and ratchet wheel the present invention is able to eliminate the oscillatory movement of the friction ring which causes the over-correction and under-correction of the yarn unwinding rate. Indeed, the stepping motor used in the present invention, to adjust the beam section's angular velocity, is able to make very small changes in the yarn unwinding rate that correspond to adjustments to the actual runner-length as small as one hundredth (1/100) of an inch. Therefore any overshoot or undershoot of the desired runner-length is negligible. Furthermore, since the invention is able to control the runner-length of yarn to any desired value set by the operator, there is no need for other means to be employed to measure the runner-length.

The present invention is therefore clearly distinguishable from the prior art. In U.S. Pat. No. 3,626,725 entitled "Runner Checker Apparatus for Warp Knitting Machines", a device is disclosed for measuring the length of yarn fed from a warp beam section of a warp beam knitting machine. This patent discloses an apparatus which is able to display the runner-length of yarn as each rack of fabric is knitted. The disclosed apparatus employs a means for counting pulses related to the yarn unwinding rate, whereby this count is terminated after 480 main shaft revolutions have occurred. This count is then displayed in terms of the runner-length of yarn fed from the beam section. Thus the disclosed apparatus automatically measures the actual runner-length but does not correct it in any manner.

The present invention allows the operator to manually select the desired runner-length by appropriately setting thumb wheel switches. Thus, the present invention does not utilize a counting technique as described in U.S. Pat. No. 3,626,725, but instead controls the runner-length of yarn by continuously monitoring the unwinding rate of the yarn and simultaneously adjusting this unwinding rate continuously to yield the desired runner-length.

The present invention is also clearly distinguishable from U.S. Pat. No. 3,543,360 entitled "Yarn Inspector", wherein a yarn defect detection device is disclosed incorporating a yarn length measuring device for purposes of displaying the defects as a function of yarn length. The present invention does not employ a yarn length measuring device, but instead continuously adjusts the unwinding rate of the yarn to yield a desired runner-length. U.S. Pat. No. 3,543,360 does not employ any type of yarn unwinding rate control device, but merely detects and displays defects in the yarn sheet per selected length increment of the yarn sheet.

Furthermore, U.S. Pat. No. 3,648,338, entitled "Automatic Tension Control Apparatus", does not anticipate the present invention. This patent discloses a device that automatically controls the packing density of filaments on a reel. It utilizes information of the filament speed and information of the desired filament speed to adjust the reel's angular velocity so as to wind the filaments with a predetermined packing density. In addition to being directed toward a different invention, that patent does not teach the use of sampling an error signal related to the difference between a desired and an actual variable and reducing this sampled error to zero by monitoring the amount of control information sent to a parameter-adjusting device. That patent also requires a knowledge of the accumulated number of reel revolutions in order to generate a desired filament speed; whereas the present invention does not require or use such information to control a beam section of a warp beam knitting machine. Furthermore, U.S. Pat. No. 3,648,338 fails to teach the use of an error display system which shows the deviation between the actual and desired variable as a function of the amount of control information sent to the parameter-adjusting device.

SUMMARY OF THE INVENTION

The control apparatus of this invention performs the automatic regulation of the yarn runner-length of a beam section of a warp beam knitting machine by measuring the unwinding rate of the yarn removed from the beam section and comparing this information to a signal proportional to the desired yarn runner-length. This desired runner-length signal is produced by transforming a signal related to the main shaft angular velocity to represent a selected runner-length. Each unit of information proportional to the desired runner-length is compared to the information related to the actual unwinding rate of the yarn and thus the actual runner-length of the yarn. If this comparison of information does not yield one unit of actual runner-length information per one unit of desired runner-length information, i.e., the information is not on a one-for-one basis, an error unit is generated.

The error unit may be positive or negative depending on whether more or less information units from the actual runner-length detector are sensed during one information unit representing the desired runner-length. This error unit information is algebraically added in an error counter to the previous binary number in the counter. This updated binary number representing the total number of error units in the counter is rapidly sampled at a periodic rate into a counter register. This sampled binary number immediately activates a gate mechanism that allows a clocking device to pulse a stepping motor decoder. The decoder then activates a stepping motor which in turn adjusts the beam section's angular velocity and therefore the yarn unwinding rate and runner-length. The number of clock pulses allowed to be fed into the decoder is equal to the number of error unit signals previously sampled into the counter register. That is, the binary number representing the number of error units per sampling interval is reduced by one integer each time a clock pulse is sent to the stepping motor decoder, and when the binary coded number represents zero error units the gate mechanism is turned off preventing any further clock pulses from reaching the stepping motor decoder.

The above stepping control is performed in a period of time less than the sampling rate interval of the error counter and thus the actual runner-length of the yarn always remains within very close tolerances of the desired runner-length. After each sampling of the error counter, it is immediately reset to zero and re-initiates counting of any subsequent error units. After the next sampling interval, the counter is again examined so as to allow any further activation of the stepping motor. If there are no error units contained in the counter at the time of sampling, this information is transferred to the gate mechanisms so as to prevent adjustment of the beam section's angular velocity. The beam section's angular velocity will thus be adjusted only when information is received indicating that the unwinding rate of the yarn, and thus the runner-length of the yarn, has deviated from the desired runner-length.

The above-mentioned operation of the present invention occurs so rapidly that upon completion of 480 revolutions of the main shaft of the warp beam knitting machine the length of yarn actually unwound from the beam section will closely approximate the desired runner-length.

An error display mechanism is also provided by the invention indicating within one tenth of an inch any deviation of the actual runner-length from the desired runner-length. An error counter is utilized that counts the number of error information units sampled by the counter register during 480 revolutions of the main shaft; i.e., while one rack of fabric has been knitted. Since each error information unit represents a fixed runner-length deviation, an algebraic sum is obtainable equal to the deviation of the actual runner-length from the desired runner-length. This information is displayed by an error display device. After 480 revolutions of the main shaft, the error counter is reset to zero and resumes adding incoming error information units until it is again reset after the next 480 revolutions of the main shaft. Thus the error display indicates for each rack of knitted fabric the actual runner-length deviation from the desired runner-length.

If the deviation of the actual runner-length as indicated by the error display device is greater than a predetermined limit — such as eight-tenths of an inch — a fail-safe system is activated which will automatically shut down the knitting machine. A fail-safe override system is provided in order to allow the manual operation of the knitting machine.

Furthermore, a mode selector switch is provided that allows use of the runner-length controller in operations other than continuous knitting at a preset runner-length. In particular, the mode selector allows the controller to be used when an intermittent run or a high-speed, low-speed run is desired. When an intermittent run is selected, one of the beam sections of a multibeam section knitting machine is periodically stopped. During these stoppages, it is necessary to inhibit the controlling mechanism of the runner-length controller for that beam section so as to prevent that section from receiving stepping motor control signals during the desired stoppage time. Furthermore, when a high-speed, low-speed operation of the knitting machine is desired, the controller will only control one of the two speeds; i.e., one of the two partial runner-lengths generated by the knitting machine during the knitting of one rack of fabric. The runner-length controller is consequently inhibited during the period of time when the other speed, and therefore the other partial runner-length, is activated by the knitting machine.

Therefore, the present invention provides a means to continuously control the yarn runner-length unwound from a warp beam section of a warp beam knitting machine to within very close tolerances of a preset desired yarn runner-length. The invention also provides a means for displaying any deviation between the actual runner-length and the desired runner-length of the yarn utilized in the knitted fabric. The invention furthermore provides a means for automatically shutting down the knitting machine if this error is greater than a predetermined value. Since the actual yarn runner-length control is continuous and also since the time delay between detection of any deviation in the unwinding rate of the yarn and control related thereto is very small, the fabric knitted by the knitting machine is of much higher quality than otherwise obtainable by similar machines using conventional yarn unwinding rate controllers. Furthermore, a mode selector switch and accompanying circuitry is provided by the present invention so as to allow its use in knitting fabrics with varying course densities.

OBJECTS OF THE INVENTION

Therefore, it is a principal object of the present invention to provide a yarn runner-length controller for warp beam knitting machines that continuously monitors and adjusts the unwinding rate of the yarn so as to provide an acutal runner-length within extremely close tolerances of a desired runner-length.

It is another object of the present invention to provide a yarn runner-length controller that minimizes the time lag between sensing a yarn unwinding rate deviation and adjusting the beam section's angular velocity to eliminate this deviation.

A further object of the present invention is to provide a yarn runner-length controller which eliminates the need to manually measure the yarn runner-length.

Another object of the present invention is to provide a yarn runner-length controller that eliminates the oscillatory movement of the beam section's driving mechanism which is inherent in present-day yarn unwinding rate controllers.

An additional object of the present invention is to provide a yarn runner-length controller capable of continuously displaying the desired and actual runner-length throughout the knitting operation.

A further object of the present invention is to provide a yarn runner-length controller with a display system for indicating any deviation of the actual runner-length from the desired runner-length.

Another object of the present invention is to provide a yarn runner-length controller that is easy to operate.

A further object of the present invention is to provide a yarn runner-length controller that automatically shuts down a warp beam knitting machine when the actual runner-length deviates from a desired runner-length by more than a predetermined amount.

An additional object of the present invention is to provide a yarn runner-length controller that is able to operate in a non-continuous manner.

Other objects of the invention will in part be obvious and will in part appear hereinafter.

THE DRAWINGS

FIG. 2 is a schematic diagram of the mode selector, the inhibitor, the up/down gate, and the synchronizer clock shown in FIG. 1;

DETAILED DESCRIPTION

The System

Figure 1:
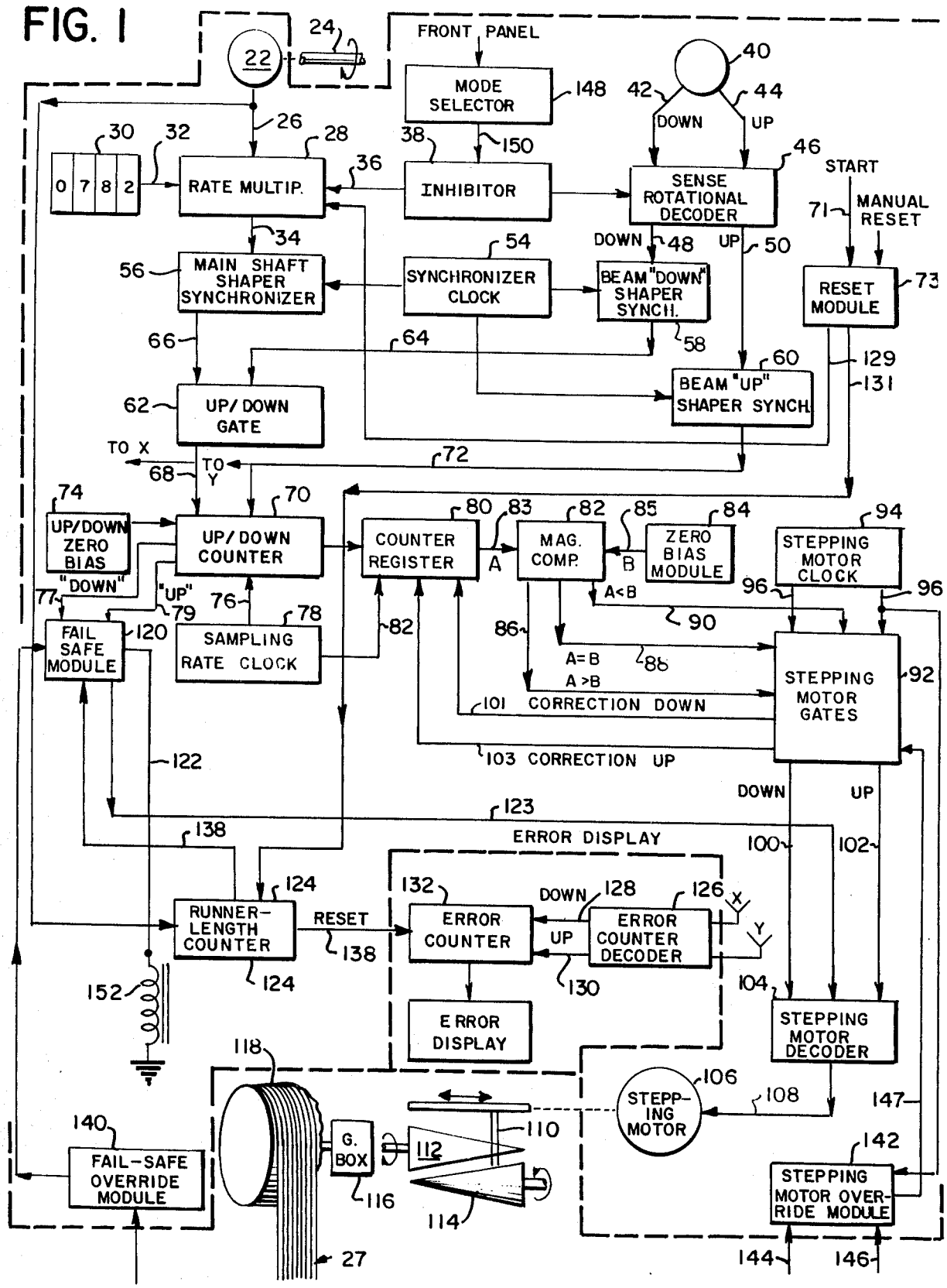
FIG. 1 is a block diagram of a yarn runner-length controller according to the present invention.

As can best be seen in FIG. 1, a yarn runner-length controller 20 of the present invention can be considered to consist of a number of functional blocks. The functional blocks communicate with each other and with a warp beam knitting machine in a novel manner that precisely controls the length of yarn used to produce a rack of knitted fabric. In addition, due to the yarn runner-length controller's continuous control of the yarn unwinding rate from a beam section of the knitting machine, the knitted fabric produced by the machine is of very high quality with a desirable uniform size for each row of knitted fabric.

More particularly, a tachometer or encoder 22 communicates with a main shaft 24 of a warp beam knitting machine and produces 100,000 electrical pulses 26 per every 480 revolutions of the main shaft. Since the length of yarn 27 used per every 480 main shaft revolutions is by definition equal to the yarn runner-length, the 100,000 electrical pulses are directly related to this runner-length.

The electrical pulses 26 from the tachometer 22 are transferred to a rate multiplier 28 where they are digitally transformed to represent a desired yarn runner-length. The desired yarn runner-length is manually selected by setting a series of binary coded decimal (BCD) switches 30. The desired runner-length set on these switches has a resolution of one-tenth of one inch and a maximum value of 999.9 inches. Typical yarn runner-lengths vary from three inches to 200 inches and thus the switches of the present invention have both ample range and resolution to provide any desired runner-length of yarn. The BCD switches 30 produce a binary coded decimal output 32 which represents the desired runner-length of yarn.

The rate multiplier 28 receives the BCD output 32 and the electrical pulses 26 from tachometer 22 and digitally transforms these signals to produce an electrical output 34 containing a series of pulses equal to 100 times the desired runner-length per 100,000 electrical pulses generated by tachometer 22. Therefore rate multiplier 28 generates a series of pulses that represents the desired runner-length with a resolution of one hundredth of an inch. Such a resolution is much finer than any present-day yarn runner-length controllers.

An electrical signal generated by inhibitor 38 on output lines 36 prevents rate multiplier 28 from generating output pulses 34 when inhibitor 38 is activated. The conditions when inhibitor 38 is activated will be discussed further on in this description.

A beam section tachometer or encoder 40 is coupled to the yarn filaments of the beam section and generates a series of electrical pulses corresponding to the length of yarn unwound from the beam section. Since the beam section is uniform, all the yarn filaments unwind from the section at very nearly the same rate; and therefore, a measurement of one or a few yarn filaments is sufficient to ascertain the length of yarn unwound for any other yarn filament of the yarn sheet.

The unwound yarn filaments are then knitted by the needles of the knitting machine. Since the knitting machine's needles pull on the unwound yarn in a discontinuous fashion, the unwinding yarn can be repeatedly jerked causing the unwound yarn to move toward the beam section during each jerking motion. The beam section tachometer 40 senses this reverse motion and generates pulsed output signals 42 and 44 that represent the length of yarn unwound as well as the length that moved toward the beam section. More particularly, output signal 44 represents the length of yarn unwound; i.e., the yarn in the UP position, whereas output signal 42 represents the length of yarn of each jerking motion of the unwound yarn; i.e., the yarn in the DOWN position.

A sense rotational decoder 46 electrically separates the electrical pulses representing the downward movement and the upward movement of the beam section into two sets of electrical pulses, a DOWN output 48 and an UP output 50. As will be discussed more fully later in this description, inhibitor 38 generates an electrical signal on output lines 36 that prevents the transmission of DOWN and UP outputs 48 and 50 when the warp beam knitting machine is in a mode where yarn runner-length control is undesirable. Such modes will be discussed later in the present description.

A synchronizer clock 54 generates high frequency electrical pulses which are transferred to a main shaft shaper-synchronizer 56, a beam DOWN shaper-synchronizer 58, and a beam UP shaper-synchronizer 60.

The main shaft shaper-synchronizer 56 electrically shapes and times the electrical output 34 of rate multiplier 28 so as to be compatible with an up/down gate 62. The electrical pulses from synchronizer clock 54 provide the timing information to the shaper-synchronizer so that incoming electrical pulses from different sources arrive at the up/down gate 62 in a non-simultaneous fashion. Similarly, the beam DOWN shaper-synchronizer 58 and the beam UP shaper-synchronizer 60 provide similar shaping and timing transformation to the DOWN output 48 and UP output 50 respectively.

If there is no jitter in the beam section tachometer 40, only UP output signals 44 are generated by the tachometer. In this case DOWN output signals are not generated by the beam tachometer, and therefore no DOWN output pulses are generated on output line 64 of the beam DOWN shapersynchronizer 58. The output of the main shaft tachometer then causes the generation of a series of pulses on output line 66 of the main shaft shaper-synchronizer 56. The up/down gate 62 then generates a series of pulses on its output line 68 equal to the number of pulses generated by output line 66.

An up/down counter 70 is utilized to account for incoming electrical pulses on output lines 68 and 72. This counter has a binary capacity of 11111111 or 255 decimal (including 0) and is initially set to binary number 10000000 or 128 decimal which is referred to as an arbitrary zero set.

The up/down counter 70 receives the outputs of up/down gate 62 and beam UP shaper-synchronizer 60. For every pulse on output line 68 the up/down counter subtracts one binary integer from the number previously stored in the up/down counter. Similarly, for every pulse received on output line 72, the up/down counter adds one binary integer to this number.

Therefore, for every pulse received by the up/down counter from output line 68 without a corresponding pulse from output line 72, one DOWN error unit is obtained. This error unit is stored by the counter by subtracting one binary integer from its previous number and this unit represents the condition where the actual length of yarn unwound from the beam is one hundredth of an inch less than the desired unwound length. Contrariwise, a pulse received on line 72 without a corresponding pulse on line 68 represents one UP error unit; i.e., the condition where the actual length of yarn unwound is one hundredth of an inch greater than the desired length. This condition is stored by the up/down counter by adding one binary integer to its previous number. Since the initial setting of the up/down counter is at the midpoint of its capacity, the counter has sufficient range to accept a multiplicity of error units in either the UP or DOWN direction.

If, however, the beam section does contain jitter; i.e., the yarn unwinding from the beam section intermittently moves in a reverse direction from its normal unwinding direction, a DOWN output signal is generated by the beam section tachometer 40 which causes pulses to be generated on output line 64 of the beam DOWN shapersynchronizer 58. These pulses represent the reverse motion of the yarn as it unwinds from the beam section and generate pulses on the output line 68 of the up/down gate 62.

Since the jerking motion of the yarn filaments is momentary, the filaments will return to their pre-jitter state. Therefore for every pulse generated in the DOWN direction, the beam tachometer will also produce a pulse in the UP direction. These pulses are transferred to up/down counter 70 via output line 72.

Due to the timing of the pulses on output lines 68 and 72, the up/down counter will first receive the pulse on line 68 and then the pulse on line 72. In turn, the up/down counter 70 will respectively first subtract one binary integer from its pre-existing number and subsequently add one binary integer to this number.

Thus the up/down counter will return to its previous number and effectively neutralize the two pulses generated on the DOWN and the UP outputs of the beam section tachometer. This result represents the actual unwinding condition of the yarn since the yarn did not unwind during the time that jitter existed on the unwinding yarn. More particularly, since the yarn moved in the reverse direction for a given distance and similarly moved in the forward direction an equal distance, a net unwinding length of zero actually occurred. The up/down counter 70 indicates that this has occurred when its previous number is unchanged by the receipt of the error pulses from the up/down gate 68 and the beam UP shaper-synchronizer 60.

If during the interval of time when the yarn is moving toward the beam section, a pulse is received by the up/down gate 62 from the main shaft shaper-synchronizer 56, this pulse and the pulse from the beam DOWN shapersynchronizer will cause two pulses to be generated by up/down gate 62. Therefore, the pulse on output line 72 from the beam UP shaper-synchronizer 60 will cancel out the jitter DOWN pulse but will not affect the pulse from the main shaft shaper-synchronizer.

By receiving pulses from the up/down gate 62 and the beam UP shaper-synchronizer 60, the up/down counter 70 algebraically sums all incoming information regarding the desired runner-length and the actual runner-length. At any particular instant if the binary number in the up/down counter is less than the zero bias number, (decimal 128), the up/down counter indicates that the actual runnerlength is less than the desired runner-length; and similarly, if the number is greater than the zero bias number, (decimal 128), the up/down counter indicates that the actual runner-length is greater than the desired runner-length. Thus any deviation from the zero bias number is an indication of the direction and magnitude of the error between the actual runner-length and the desired runner-length. As mentioned earlier, each binary integer difference between the zero bias number and the actual number in the counter represents one hundredth of an inch of error.

A counter register 80 retrieves the binary number in the up/down counter representing the amount of error between the actual and desired runner-lengths upon receipt of a rising pulse edge representing a load signal 82 from the sampling rate clock 78. The sampling rate clock generates this pulse every 0.3 seconds where the falling edge of this pulse represents a reset signal 76 that causes the number in the up/down counter to be reset to the zero bias number. Thus the accumulated error in the up/down counter is sampled every 0.3 seconds and is also reset every 0.3 seconds.

Upon receipt of the binary number in the up/down counter, the counter register 80 feeds this binary number to a magnitude comparator 82 via output lines 83. The value of the binary number on lines 83 is denoted as "A" (see FIGS. 1 and 6). Here the binary number is compared to another binary number generated by a zero bias module 84 and transferred on output lines 85. The value of this binary number is denoted as "B". This number is actually identical to the number generated by the up/down zero bias module 74, and thus if the value of A is greater than the value of B, the magnitude comparator will generate a high level output on line 86 and a low level output on lines 88 and 90. Line 86 represents the condition where the binary number on lines 83 is greater than the binary number on lines 85. Similarly, line 90 represents the condition where binary number 83 is less than binary number on lines 85 and line 88 represents the condition where the binary number on lines 83 equals the binary number on lines 85.

Output lines 86, 88 and 90 are connected to stepping motor gates 92. A stepping motor clock 94 generates a series of electrical pulses every 10 milliseconds and transfers these pulses via output lines 96 to stepping motor gates 92. The clock pulses on output line 96 are transferred to gate output line 100 if line 86 is at a high or "ON" level or output line 102 if line 90 is at a high or ON state (A less than B). This former state represents the condition where output lines 83 are greater than the binary number on zero bias output lines 85, thus indicating that the yarn unwinding rate is greater than the desired yarn unwinding rate. Similarly, the latter state represents the reverse condition, where output lines 83 are less than the binary number on zero bias lines 85, thus indicating that the yarn unwinding rate is less than the desired unwinding rate.

The electrical pulses on gate output line 100 or 102 are transferred to a stepping motor decoder 104 where the pulses are electrically buffered and transferred to a stepping motor 106 via output line 108.

Upon receipt of each electrical pulse on output line 108, stepping motor 106 moves one position clockwise or counterclockwise depending upon whether gate output line 100 or gate output line 102 transfers the electrical pulses. Each time the stepping motor moves one position a speed adjusting ring 110 moves an incremental amount along the horizontal axis of a speed adjusting cone 112. Since rotational energy is imparted to speed adjusting ring 110 via a constant speed control cone 114, horizontal movement of the ring will cause the angular velocity of speed adjusting cone 112 to vary by a very small amount. The speed adjusting cone is mechanically coupled to a gear box 116 which in turn is mechanically coupled to the beam section 118 for providing the desired angular velocity to beam section 118. Since the unwinding rate of yarn 27 from the beam section is measured by beam section tachometer 40 with a resolution of one hundredth of an inch, each step by stepping motor 106 in response to an electrical pulse on output line 108 causes the beam section's angular velocity to be adjusted by amount approximately equal to the amount necessary to correct for a hundredth of an inch deviation in yarn runner-length.

More particularly, if after 0.3 seconds one more electrical pulse is received by up/down counter 70 from output line 72 than from output line 68, the binary number in the up/down counter is one binary integer greater than the zero bias number. Therefore, the value of A on output line 83 is greater than the value of B on output line 85, thus causing output line 86 to be in the ON condition. This ON condition causes an electrical pulse to occur on gate output line 100 and finally on output line 108. Since each pulse generated by beam section tachometer 40 represents a hundredth of an inch of yarn, the one extra pulse during the 0.3 second sampling time represents a deviation in the desired unwinding rate of 0.01/0.3, or 0.033 inches per second. Because the unwinding rate of the yarn is equal to the angular velocity of the beam section times the radius of the yarn with respect to the center of the beam section, the amount of angular velocity represented by the unwinding rate deviation is:

$$\Delta w = \Delta v/R$$

$$\Delta w = 0.033/R$$

(radians per second); where $\Delta w$ is the change in angular velocity, $\Delta v$ is the deviation in unwinding rate, and $R$ is the radius of the unwinding yarn about the beam axis. Since the radius of the yarn about the beam section varies between a predetermined maximum and minimum, an average value of the radius, Rav, is chosen with respect to the amount of angular velocity change per position of stepping motor 106. For a typical knitting machine where Rav is equal to 15 inches, the amount of change in the angular velocity of the beam section per deviation of one hundredth of an inch in runner-length is:

$$\Delta w = 0.033/Rav \quad \text{(radians/second} = 0.033/15 = 0.0022 \text{ radians/second.}$$

Thus each position of stepping motor 106 causes speed adjusting ring 110 to move an incremental amount capable of changing the beam section's angular velocity by the above amount. Since the control cone 114 has a uniform variation in radius throughout its horizontal length, and also since the change in angular velocity of speed adjusting cone 112 is directly proportional to the change in the contacting radius of control cone 114 with speed adjusting ring 110, the above change in angular velocity to the beam section is obtainable regardless of where speed adjusting ring 110 makes contact with control cone 114. Thus the above change in angular velocity of the beam section per positional change of stepping motor 106 is obtainable regardless of the particular angular velocity of the beam section.

In the above situation where the binary number on output line 83 is greater than output line 85, thus causing output line 86 to be in the ON state, gate output line 100 continues to carry electrical pulses from stepping motor clock 94 to stepping motor decoder 104 until output line 88 is in the ON state. At this point the binary number on output line 83 is equal to the binary number on output line 85 and the energization of output line 88 prevents any clocking pulses from stepping motor clock 94 from being transferred to stepping motor decoder 104.

The binary number on output line 83 is changed after each sampling of the up/down counter 70 via the electrical pulses on output lines 101 and 103 from the stepping motor gates. Each electrical pulse on output line 101 causes the binary number in counter register 80 to decrease by one binary integer, and similarly each electrical pulse on output line 103 causes the binary number to increase by one integer. Therefore, the number of electrical pulses transferred to stepping motor decoder 104 is equal to the magnitude of difference between the sampled number in counter register 80 and zero bias 84. It is therefore readily apparent that the amount of change in the angular velocity of the beam section and thus in the actual runner-length of yarn from this beam section is approximately equal to the amount of deviation between the actual and desired runner-length per sampling interval.

Since stepping motor clock 94 produces an electrical pulse every 10 milliseconds, the binary number in counter register 80 is returned to the zero bias binary number before the next sampled error signal from up/down counter 70 is retrieved. Any error between the actual and desired runner-lengths per 0.3 second sampling interval is completely acted upon before the next sampled error signal is retrieved during the following 0.3 second interval. It therefore does not matter whether the amount of angular velocity change in the beam section is exactly equal to that needed to cause the actual amount of yarn unwound to equal the desired amount of yarn unwound per 0.3 second interval, because any remaining deviation between the actual and desired yarn unwinding rates will be resampled by the counter register and re-acted upon by the magnitude comparator. In the actual operation therefore, the rapid sampling of the deviation between the actual and desired unwinding rate of yarn is so swift that an approximate adjustment per sampling interval in the angular velocity of the beam section will yield an actual runner-length of yarn within a few hundredths of one inch of the desired yarn runner-length.

The above sequence of controlling events by yarn runner-length controller 20 also occurs when the binary number on output line 83 is less than the binary number on zero bias output line 85, causing output line 90 to be in the ON state. This state causes stepping motor gates 92 to allow electrical pulses from stepping motor clock output line 96 to be transferred to gate output line 102. These pulses in turn cause stepping motor 106 to move in steps of the opposite direction than when electrical pulses occurred on gate output line 100. Similarly, gate output line 103 will cause the binary number in counter register 80 to be increased by one binary integer each time an electrical pulse occurs on that line. Thus when the binary number on output line 83 equals a zero bias binary number on output line 85, output lines 86 and 90 will be in the OFF state and output line 88 will be in the ON state. This ON state prevents any further electrical pulses from occurring on output line 102 while preventing the initiation of pulses on output line 100.

As best seen in FIG. 1, the present invention also includes a fail-safe module 120 that senses the number of electrical pulses sent to up/down counter 70 via output lines 68 and 72. The fail-safe module algebraically adds these pulses and if the absolute value of this algebraic sum of electrical pulses is greater than 80 — representing a 0.8 inch deviation between the actual and desired runner-length — per 480 revolutions of the main shaft 22, it energizes output lines 122 and 123, causing the knitting machine to stop. The information concerning the 480 revolutions of the main shaft is provided by a runner-length counter 124 that accumulates electrical pulses from the main shaft tachometer 22 until 100,000 pulses are received. The 100,000 pulses represent 480 revolutions of the main shaft of the knitting machine. If an absolute value of 80 is not obtained by the fail-safe module during the 480 revolutions of the main shaft, the output line of the fail-safe module remains de-activated and the knitting machine remains energized. In this case fail-safe module is reset to zero counts by the runner-length so as to continue its monitoring of the up/down counter.

The fail-safe module 120 and the rate multiplier 28 are initially reset to zero when "START" line 125 is activated causing a reset module 127 to generate a reset pulse on output lines 129 and 131. The START line is activated when automatic control by yarn runner-length controller 20 is desired. Therefore any binary number previously stored in the fail-safe module is undesired since it is unrelated to the current yarn control operation.

The present invention also includes an external error display incorporating an error counter decoder 126 that receives all electrical pulses on lines 68 and 72 and generates one electrical pulse on output line 128 or 130 for every 10 electrical pulses respectively received. Since every pulse on line 68 or 72 represents a deviation between the actual and desired runner-length of one hundredth of one inch, each output pulse generated by error counter decoder 126 represents a deviation in the actual runner-length of one tenth of one inch. These output lines are connected to an error counter 132 where they are algebraically summed during every 480 revolutions of the main shaft. The binary number accumulated by the error counter after a reset signal is received from runner-length counter 124 represents the total runner-length deviation between the acutal and desired runner-length. This number is continually transferred to an error display 134 via output line 136. The error display transfers the binary number into a visual display representing the decimal value of the binary number. Thus the deviation between the actual and desired length is displayed with a resolution of one tenth of one inch. After 480 revolutions of the main shaft, the runner-length counter will have received 100,000 electrical pulses from the main shaft tachometer 22 and will cause a reset pulse 138 to be transferred to the error counter 132 causing the error counter to reset its accumulated error to a binary number representing zero error. The error counter is then able to display the deviation between the actual and desired runner-length for the next rack of knitted cloth.

The error counter may be designed to transfer on output line 136 only the binary number just prior to reset. This number represents to total deviation of the actual runner-length and could be displayed by error display 134 during the time interval when the following rack of fabric is being knitted. This number when algebraically added to the desired runner-length display on BCD switches 30 yields the actual runner-length for each rack of knitted fabric. Indeed the actual runner-length may be displayed by algebraically adding the electrical pulses on output lines 66, 128 and 130.

The present invention includes a fail-safe override module 140 which prevents the operation of the fail-safe module when the override module is energized. When the fail-safe override module is energized the stepping motor override module 142 is also activated in either an UP or DOWN configuration via input lines 144 and 146 respectively. The stepping motor override module allows the stepping motor decoder 104 to be activated in an UP or DOWN direction by stepping motor clock pulses on line 96 by deactivating stepping motor gates 92 via an electrical signal on output line 147. In turn, the stepping motor decoder allows the operator to initially place speed adjusting ring 110 to a position that will approximately yield a new desired runner-length. Under such conditions if the approximate angular velocity of the beam section is unknown, the up/down counter 70 would generate a large enough error signal to trigger the fail-safe module if it was not de-energized. Thus the remote control signals to the fail-safe override and stepping motor override modules allow the operator to manually control the knitting machine so as to position the speed adjusting ring 110 to the position on speed adjusting cone 112 in order to obtain the approximate desired yarn runner-length. Once this initial setup is completed the override modules are deactivated allowing the yarn runner-length controller to automatically control the actual yarn runner-length. At this time the START line 127 is activated.

A mode selector 146 is provided in the present invention to allow the use of the invention in modes other than a continuous preset desired runner-length. More particularly, if the knitting operation calls for two partial runner-lengths to be used per rack of knitted cloth, the mode selector is set to allow the one with the greater number of courses to be controlled by the present invention. When switching to the other partial runner-lengthh control, the ring 110 is in the proper position, and no significant error can accumulate during the few courses during which the controller is inactivated. Whatever minor error develops is rapidly compensated the moment the controller is reactivated. It is for this reason that the knitting machine is activated for the partial runner-length with the greater number of courses. The mode selector during this other period of time generates an output signal on output line 150 so as to cause inhibitor 38 to prevent the generation of electrical pulses by rate multiplier 28 and sense rotational decoder 46.

Another permissible mode of operation of the beam section controlled by the present invention is to have the beam section stopped during part of the time when one rack of knitted cloth is being knitted. In such a situation, other beams of the warp beam kintting machine are still being controlled while the yarn on the beam section where this particular condition exists is stopped. This mode of operation causes pattern effects in the knitted fabric. A mode selector position is chosen that will energize the inhibitor 38 during the periods of time when beam section 118 is to be de-energized. It must be understood that the controller section described applies to one bar. Actually, there is an independent controller for each bar of the knitting machine. Each bar is thus independently controlled.

Figure 7:
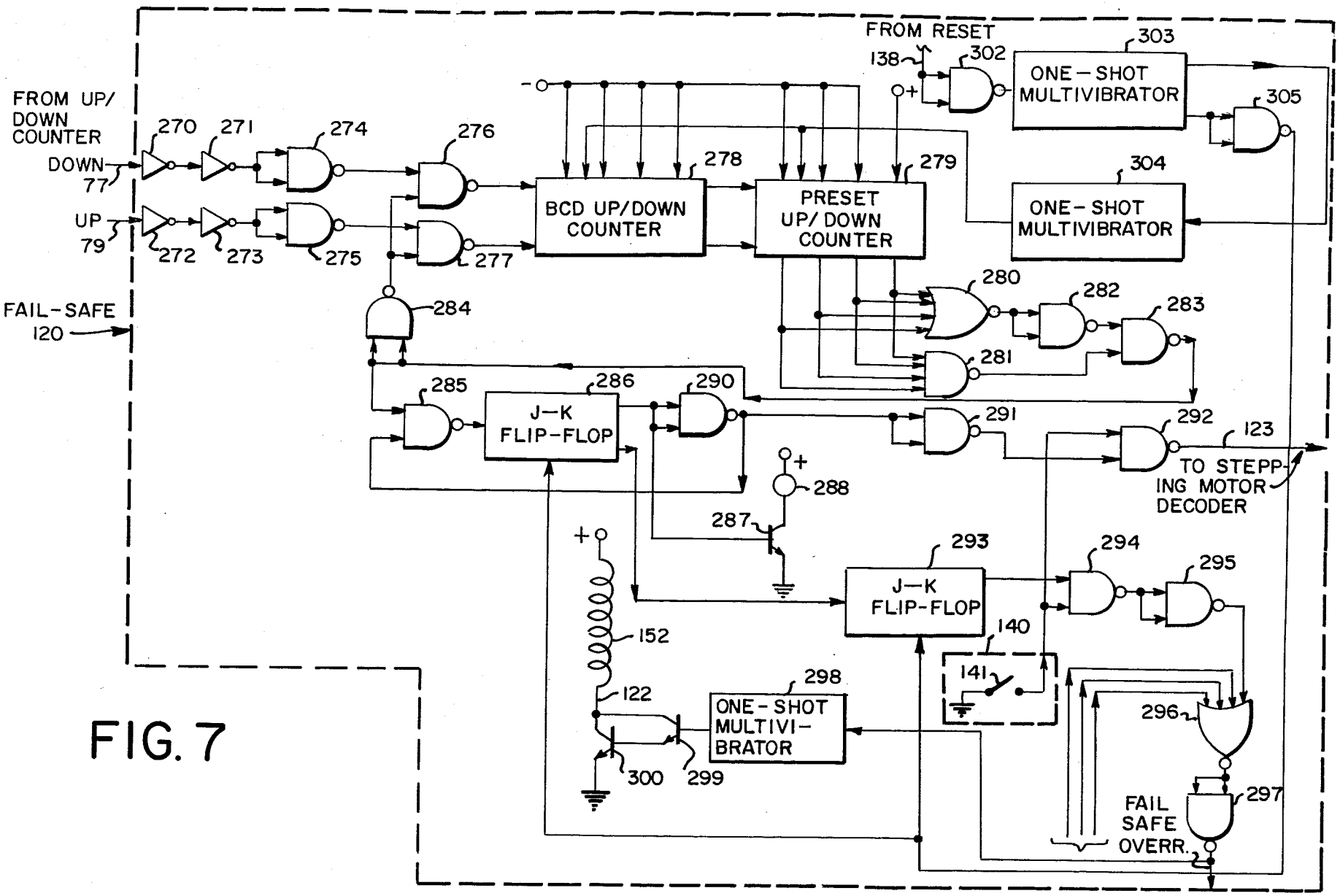
FIG. 7 is a schematic diagram of the fail-safe module and the fail-safe override module shown in FIG. 1.

Thus as may readily be seen, multiple devices of the present invention may be used on several beam sections of a warp beam knitting machine where each yarn runner-length controller 20 controls the runner-length of that particular beam section of the knitting machine. As best seen in FIG. 7, in such a configuration the output lines 122 of each fail-safe module 120 are logically "ored" so as to cause a shut-down relay 152 to be energized when any fail-safe output line is energized. The knitting operation is therefore terminated when any beam section of the knitting machine generates an error signal large enough to energize its fail-safe output line.

Operation of the Yarn Runner-Length Controller

The operation of a yarn runner-length controller 20 of the present invention is both fast and efficient.

As best seen in FIGS. 1 and 2, the mode of operation of the knitting machine is chosen on the mode selector 148. If a continuous yarn runner-length is desired, rotary switch 154 is set at the "NORMAL" position. In this position the controller will continuously control the yarn runner-length.

Figure 3:
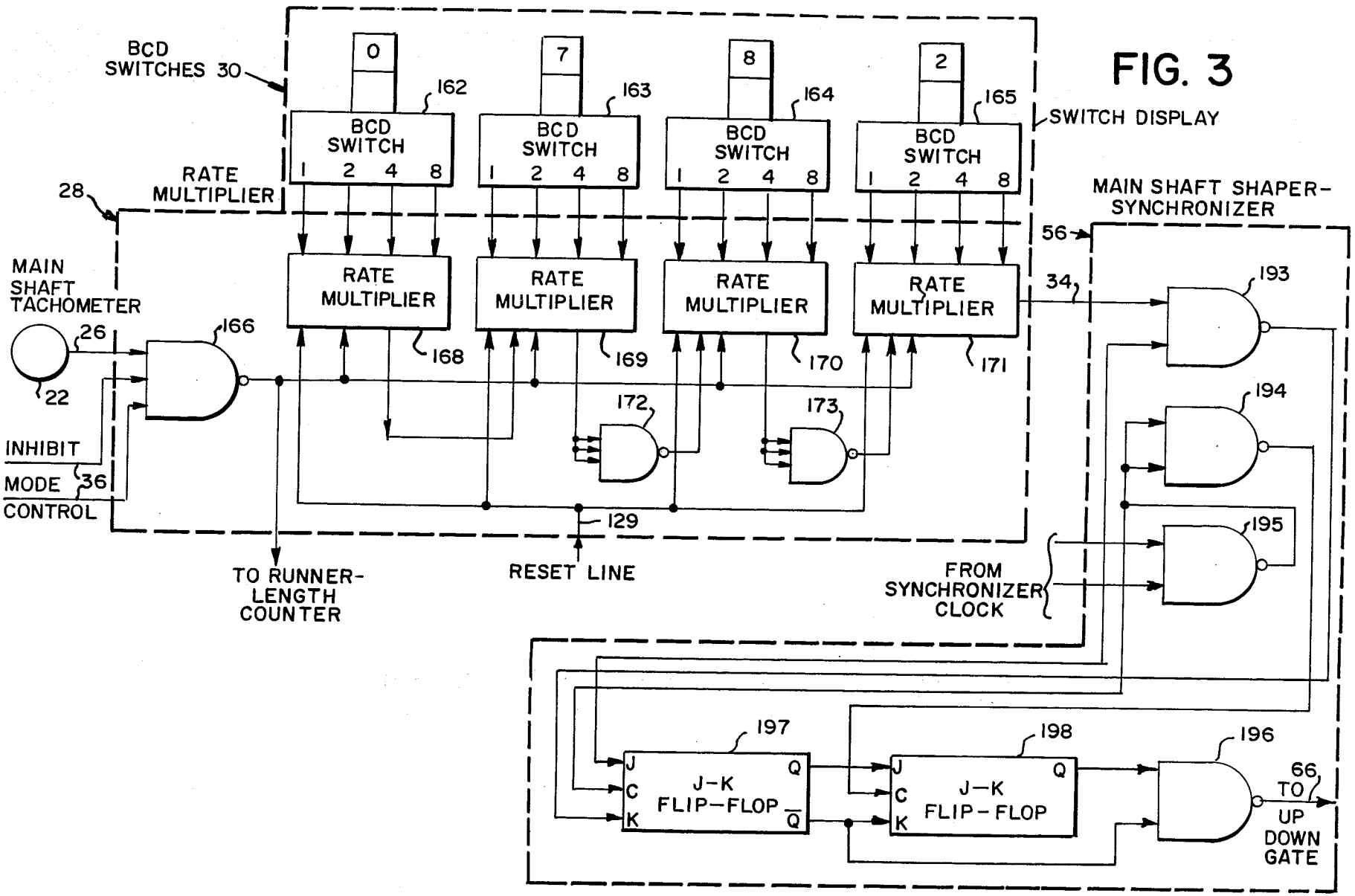
FIG. 3 is a schematic diagram of the rate multiplier and the main shaft shaper-synchronizer shown in FIG. 1.

As seen in FIGS. 1 and 3, the BCD switches 30 are then set to the desired yarn runner-length. This desired runner-length has a resolution of one tenth of one inch.

Figure 8:
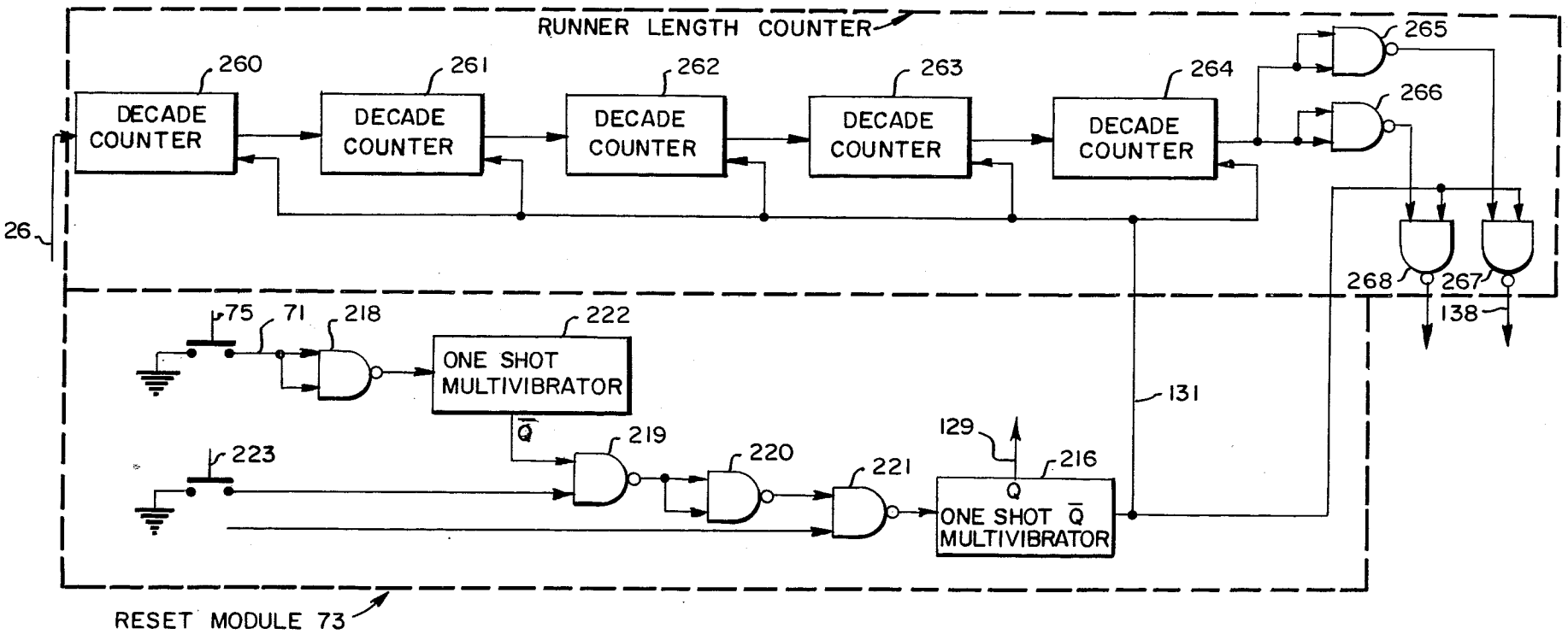
FIG. 8 is a schematic diagram of the reset module and the runner-length counter shown in FIG. 1.

As best seen in FIGS. 1 and 8, following the selection of the desired runner-length, the reset module 73 is activated by energizing "START" line 71 via pushbutton switch 75 located on the knitting machine. Reset module 73 then causes rate multiplier 28, fail-safe module 120, runner-length counter 124, and error counter 132 to be set to their zero bias position. Sampling rate clock 78 automatically resets up/down counter 70. At the time pushbutton 75 is depressed, fail-safe module 120, runner-length counter 124, and error counter 132 are automatically reset without any further manual activation.

Figure 6:
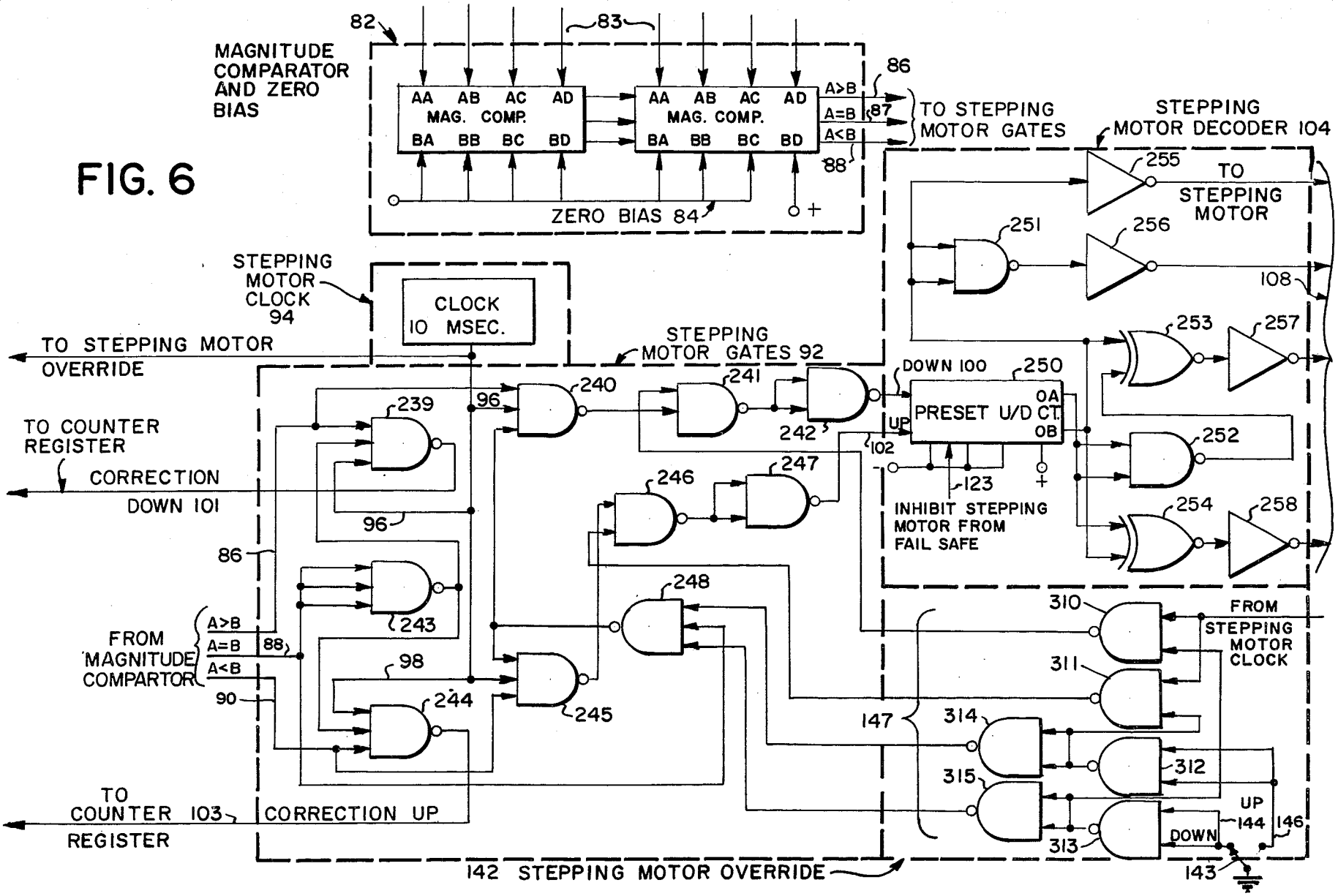
FIG. 6 is a schematic diagram of the magnitude comparator, the zero bias, the stepping motor gates, the stepping motor decoder, and the stepping motor override module shown in FIG. 1.

Next, as best seen in FIGS. 1, 6 and 7, the fail-safe override module 140 and the stepping motor override module 142 are activated by switches 141 and 143 respectively so as to allow the operator to manually set speed adjusting ring 110 to the position that will yield the approximate desired yarn runner-length. Once the ring has been positioned the override modules are deactivated causing the yarn runner-length controller to begin the automatic control of the yarn runner-length.

This automatic control of the yarn runner-length will continue until the load selector switch 154 is placed in the OFF position or until the fail-safe module 120 terminates the knitting operation.

If the desired knitting operation requires two partial yarn runner-lengths per rack of knitted cloth, the present invention can only control one of the two partial runner-lengths. The mode selector switch 154 is then placed in either the "HIGH" position or the "LOW" position depending on whether the longer or shorter partial runner-length is desired to be controlled (see FIG. 2). More particularly, the partial runner-length that is used for the greater percentage of time (greater number of courses) is chosen so as to provide the greater amount of control time to the total knitting operation. During the knitting of the uncontrolled partial runner-length beam inhibit switch 156 closes thus energizing inhibitor 38.

Similarly, in a knitting operation utilizing more than one beam section where a controlled beam section is stopped during a portion of the knitting operation, the mode control switch 154 is placed in the NORMAL-HIGH position where beam inhibit switch 156 activates inhibitor 38 (see FIG. 1) when the beam is stopped.

The Functional Blocks

The functional blocks of the present invention primarily consist of integrated circuit chips that perform various electronic functions including clocking, counting, electrical pulse shaping and timing, as well as various logic operations. As best seen in FIG. 2, the mode selector 148 comprises a switch 154 that operates in conjunction with a "nand" gate 158 and a beam inhibit switch 156 to provide the desired modes of operation of the present invention.

Inhibitor 38 utilizes an inhibit switch 160 for preventing pulses generated by the main shaft tachometer 22 and the beam tachometer 40 (see FIG. 1) from entering the rate multiplier 28 and the sense rotational decoder 46 respectively. The mode selector and inhibitor although comprising two functional blocks as shown in FIG. 1 are actually interrelated since the mode selector causes the rate multiplier and sense rotational decoder to be deactivated when beam inhibit switch 156 is closed or when switch 154 is in the OFF position.

As best seen in FIG. 3, the binary coded decimal switches 30 comprise four BCD switches 162, 163, 164 and 165. Each switch has four output lines which code the chosen decimal number into a binary coded decimal number. Each switch also displays the chosen decimal number. A typical desired runner-length of 78.2 inches is displayed by the switches shown in FIG. 3.

Rate multiplier 28 comprises a nand gate 166 that allows electrical pulses 26 generated by main shaft tachometer 22 to be transferred to the clock inputs of the rate multipliers if the inhibitor output lines 36 are not at a ground state. Four integrated circuit chips 168, 169, 170, and 172 (Texas Instruments, Part No. SN 74167N) and two nand gates 172 and 173 are utilized to multiply the desired runner-length by a factor of 100 per every 100,000 main shaft tachometer electrical pulses 26.

Figure 4:
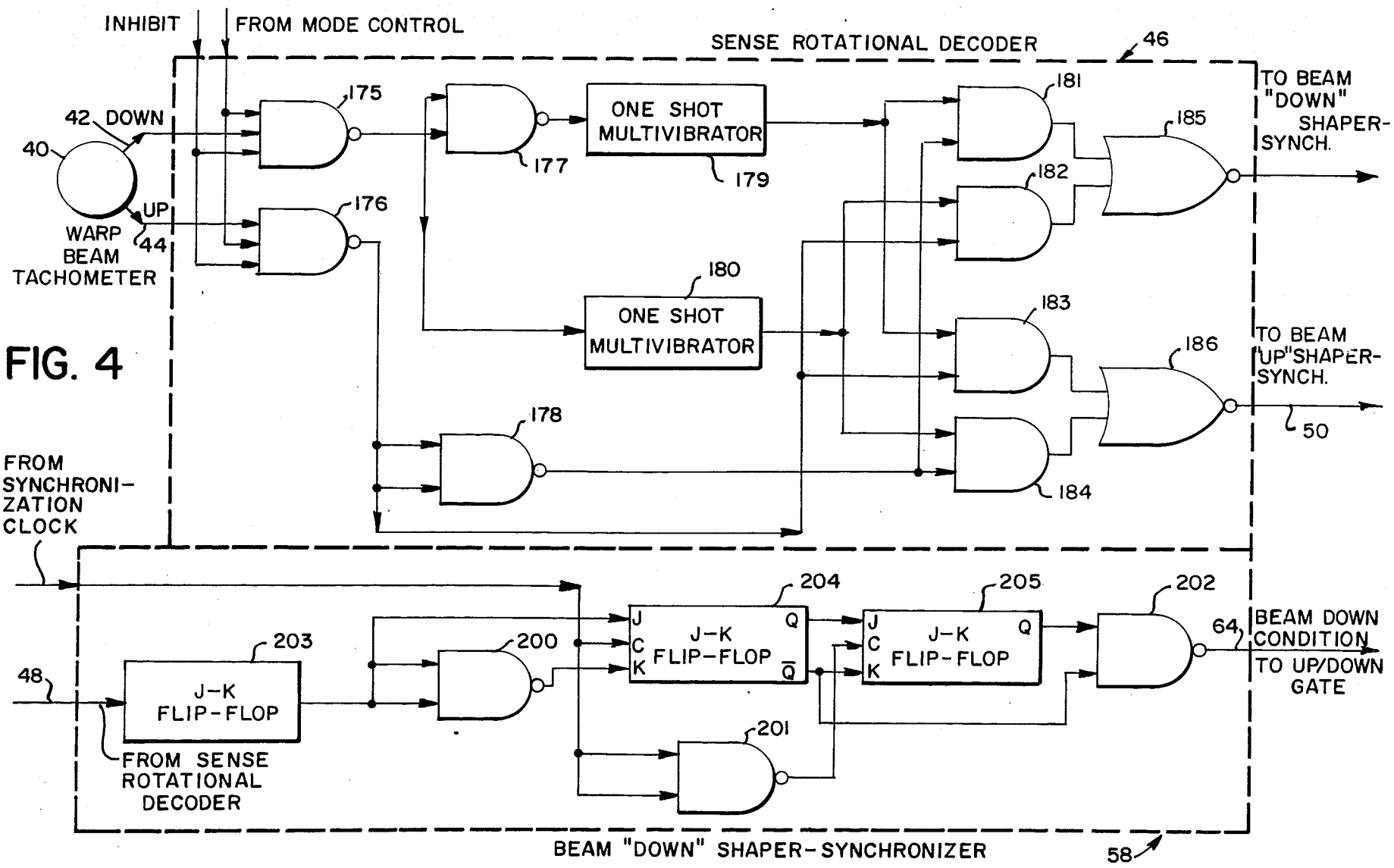
FIG. 4 is a schematic diagram of the sense rotational decoder and the beam "DOWN" shaper-synchronizer shown in FIG. 1.

Similarly, as best shown in FIGS. 1 and 4, sense rotational decoder 46 utilizes two nand gates 175 and 176 to allow electrical pulses generated by wrap beam tachometer 40 to reach the remainder of the decoder if neither output lines 36 are at a ground condition. Nand gates 177 and 178, one-shot multivibrators 179 and 180 (Texas Instruments, Part No. SN74121N), "and" gates 181, 182, 183, 184, and "nor" gates 185 and 186 are utilized to insure that the signals generated by tachometer 40 will be properly decoded on output lines 48 and 50 respectively.

As best seen in FIG. 2, synchronizer clock 54 utilizes a 20 microsecond clock 188 (Texas Instruments, Part No. SN7402), J-K flip-flops 189 and 190 (Texas Instruments, Part No. SN7473), and nand gate 191 to generate three staggered clocking signals used by main shaft shaper-synchronizer 56, beam DOWN shaper-synchronizer 58 and beam UP shaper-synchronizer 60. These clocking signals cause the various electrical pulses to arrive at up/down gate 62 and up/down counter 70 in a staggered fashion that prevents these pulses from being improperly acted upon.

As best seen in FIGS. 1, 2 and 3, the main shaft shaper-synchronizer 56 shapes and synchronizes the electrical pulses from output line 34 with clocking signals from synchronizer clock 54. The shaper-synchronizer utilizes nand gates 193, 194, 195 and 196 and J-K flip-flops 197 and 198 (Texas Instruments, Part No. SN7473) to generate properly shaped and synchronized electrical pulses on output line 66.

Figure 5:
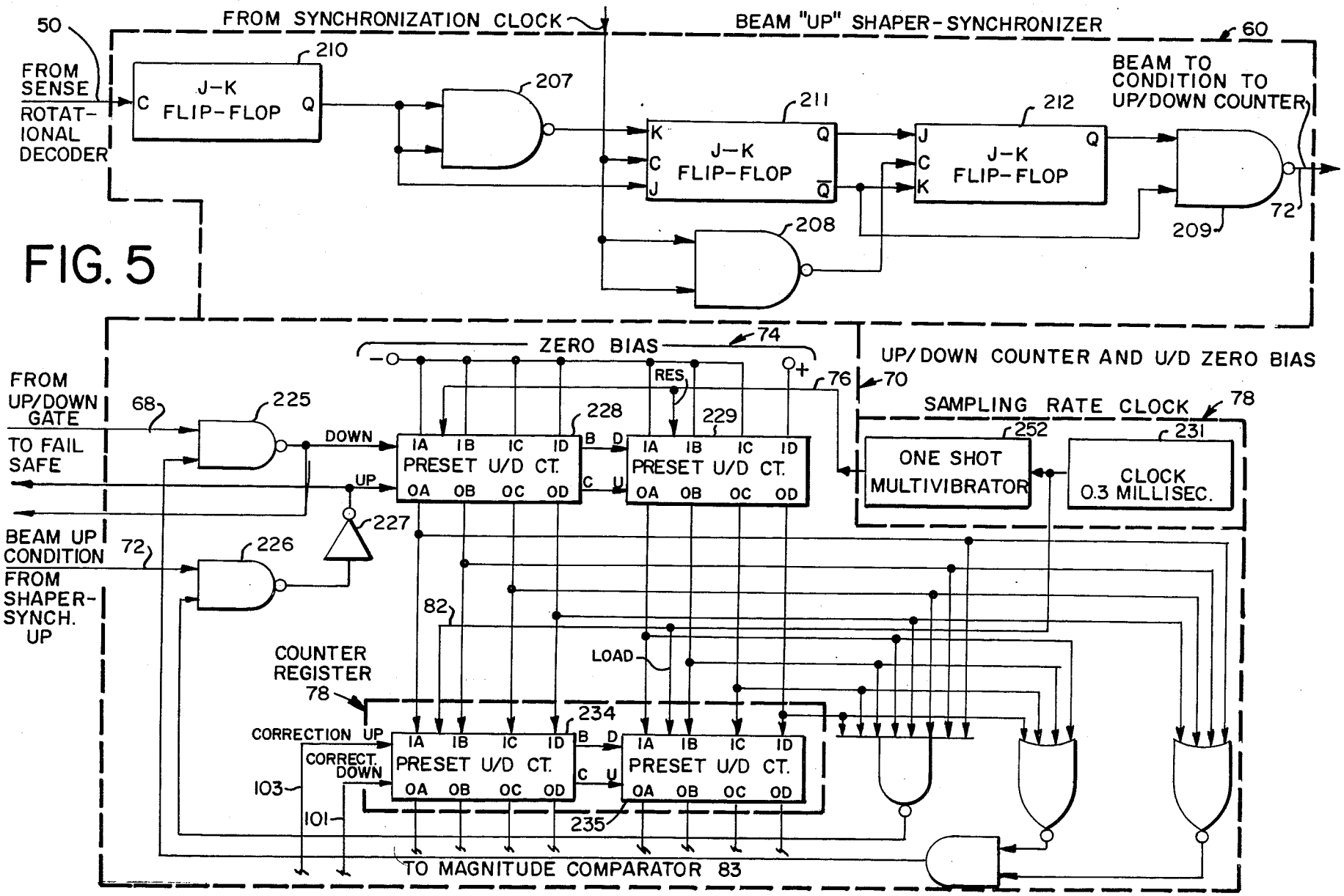
FIG. 5 is a schematic diagram of the beam "UP" shaper-synchronizer, the up/down counter, the up/-down zero bias, and the sampling rate clock shown in FIG. 1.

Similarly, as best seen in FIGS. 1, 4 and 5, beam DOWN shaper-synchronizer 58 and beam UP shaper-synchronizer 60 shape and synchronize the incoming electrical pulses on output lines 48 and 50 respectively. More particularly, the DOWN shaper-synchronizer utilizes nand gates 200 and 201 and 202 along with J-K flip-flops 203, 204, and 205 (Texas Instruments, Part No. SN7473) to produce electrical pulses on output line 64. Likewise, the UP shaper-synchronizer utilizes nand gates 207, 208, and 209 and J-K flip-flops 210, 211, and 212 to generate the proper electrical pulses on output line 72.

As best seen in FIGS. 1 and 2, the up/down gate 62 merely consists of an "exclusive nor" gate 214 (Texas Instruments, Part No. SN7486) that receives electrical pulses on output lines 64 and 66 and generates electrical pulses on output line 68.

As can be seen in FIG. 8, reset module 127 generates two output reset signals via one-shot multivibrator 216. A start switch 133 in conjunction with nand gates 218, 219, 220 and 221 and one-shot multivibrator 222 provide an electrical pulse to one-shot 216 when switch 133 is momentarily closed. A manual reset switch 223 is provided to allow the yarn runner-length controller to be reset without re-starting the controller.

As can best be seen in FIGS 1 and 5, the up/down counter 70 receives electrical signals on output lines 68 and 72 and counts these signals in a DOWN and UP direction by use of nand gates 225 and 226, invertor 227, and up/down counters 228 and 229 (Texas Instruments, Part No. SN74193). The binary number contained in up/down counters 228 and 229 is reset every 0.3 seconds by an electrical pulse generated by sampling rate clock 78 along output line 76. At such times the zero bias 74 causes the up/down counters to be set to binary number 10,000,000 due to the biasing conditions on input lines 1A, 1B, 1C, and 1D of each counter.

The sampling rate clock 78 generates the electrical pulses on output line 76 via a clock 231 and a one-shot multivibrator 232 (Texas Instruments. Part No. SN74121).

The electrical states of output lines OA, OB, OC, OD, of counters 228 and 229 are transferred into counter register 78 when sampling rate clock line 82 is energized. The counter register consists of two preset up/down counters 234 and 235 (Texas Instruments, Part No. SN74193). The received binary number is then altered by electrical pulses on output lines 101 and 103 from stepping motor gates 92. This altered binary number is retrievable on output lines OA, OB, OC, and OD of counters 234 and 235.

As seen in FIGS. 1 and 6, magnitude comparator 82 comprises two magnitude comparator chips 237 and 238 (Texas Instruments, Part No. 7485) where the outputs 83 of counter register 78 are applied to inputs AA, AB, AC, and AD, of each chip and compared to the binary number 10,000,000 generated on inputs BA, BB, BC, and BD, of each counter via zero bias 84. Output lines 86, 87, and 88 are individually set at an ON state depending on whether the binary number on output line 83 is greater than, equal to, or less than the zero bias binary number.

Stepping motor gates 92 utilize nand gates 239, 240, 241, 242, 243, 244, 245, 246, 247, and 248 to produce electrical pulses on output lines 100, 101, 102, and 103. These electrical pulses are generated in accordance with the electrical pulses generated by stepping motor clock 94 and the conditions of output lines 86, 88, and 90. Output lines 100 and 102 of the stepping motor gates are de-activated if stepping motor override output lines 147 are energized or when A equals B.

As also seen in FIGS. 1 and 6, stepping motor decoder 104 generates buffered electrical output signals on output line 108 to drive stepping motor 106 in accordance with electrical pulses on output lines 100 and 102. The decoder utilizes a preset up/down counter 250 (Texas Instruments, Part No. SN74193) as well as nand gates 251 and 252, "exclusive nor" gates 253 and 254, and inverters 255, 256, 257 and 258. If output line 123 from fail-safe module 120 is energized. the up/down counter 250 is prevented from generating additional output signals to drive the logic components.

As best seen in FIGS. 1 and 8, runner-length counter 124 performs the electrical counting of 100,000 electrical pulses generated by main shaft tachometer 22 by use of decade-counters 260, 261, 262, 263, and 264 (Texas Instruments, Part No. SN7490N). The output of decade-counter 264 generates one electrical pulse per 100,000 electrical pulses received by decade-counter 260. The output of decade-counter 264 drives nand gate 265 and 266 which in turn drives nand gate 267 and 268. The outputs of nand gate 267 and 268 are used to reset the binary coded decimal numbers stored in fail-safe module 120 and error counter 132

As best seen in FIGS. 1 and 7, fail-safe module receives error unit information from up/down counter 70 via output lines 77 and 79 and transfers this information via inverters 270, 271, 272, and 273, and nand gates 274 and 275. The output signals of nand gates 274 and 275 are then transferred by nand gates 276 and 277 where the information is transferred to BCD up/down counter 278 (Texas Instruments, Part. No. SN74192). A preset up/down counter 279 receives the output from the BCD counter and generates output signals that drive nor gate 280 and nand gate 281. These gates in turn drive nand gates 282, 283, 284 and 285. Nand gate 285 clocks J-K flip-flop 286 (Texas Instruments, Part No. SN7473) which in turn drives NPN transistor 287 causing indicator light 288 to be energized. The energization of light 288 indicates that the fail-safe system has been activated and that the knitting machine is shut-down. Flip-flop 286 also drives nand gates 290, 291 and 292 which in turn activate output line 123, preventing stepping motor decoder 104 from activating stepping motor 106. In addition flip-flop 286 drives J-K flip-flop 293 which in turn drives nand gate 294 and 295. The output of nand gate 295 is logically ored with the fail-safe outputs of other beam sections of the knitting machine via nor gate 296. The output of nor gate 296 drives nand gate 297 which in turn drives one-shot multivibrator 298 (Texas Instruments, Part No. SN74121). The one-shot then drives Darlington transistor pair 299 and 300 that energize shut-down relay 152; causing the knitting machine to be stopped.

The binary numbers stored in BCD up/down counter 278 and preset up/down counter 279 are reset to binary numbers 0000 and 1000 respectively whenever an output signal is received from runner-length counter 124 via output line 138. This reset signal is buffered by nand gate 302 which in turn drives one-shot multivibrator 303. The output of this one-shot drives another one-shot multivibrator 304 causing counters 278 and 279 to be reset. Another output of one-shot multivibrator 303 drives nand gate 305 which in turn resets flip-flops 286 and 293.

As also seen in FIGS. 1 and 7, the fail-safe override module 140 merely consists of a single-pole single-throw switch 141 which when closed, prevents nand gates 292 and 294 of fail-safe module 120 from generating energized outputs.

As shown in FIGS 1 and 6, the stepping motor override module 142 utilizes clocking information from stepping motor clock 94 and the position of external switch 143 to drive nand gates 310, 311, 312, 313, 314 and 315. The outputs of nand gates 310 and 311 drives gates 241 and 246 respectively of the stepping motor gates 92. These gates in turn drive the stepping motor decoder 104. The outputs of nand gates 314 and 315 drive nand gate 248 of the stepping motor gate 92.

Thus what has been described is a novel yarn runner-length controller which provides for the automatic control of the length of yarn used by a beam section of a warp beam knitting machine. The present invention allows the operator to "dial-in" the desired yarn runner-length whereby the controller maintains an actual runner-length nearly equal to this desired length throughout the entire knitting operation. The invention also displays any error between the desired and actual runner-length and includes a fail-safe system for shutting-down the knitting machine when the beam section is not properly operating. In addition, it is possible to directly display the actual runner-length. Furthermore, the information generated by the invention is available at output connectors where the error display system interconnects in order to be fed into a data acquisition system allowing remote supervision of a large number of knitting machines. The knitted fabric produced by knitting machines using the present invention has been found to be very high quality with uniform course density throughout.

It will thus be seen that the objects set forth above, among those made apparent from the preceding description, are efficiently attained and, since certain changes may be made in the above apparatus without departing from the scope of the invention, it is intended that all matter contained in the above description or shown in the accompanying drawings will be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed is:

1. A yarn runner-length controller for knitting machines having a main shaft and at least one beam section comprising:

A. a first metering means for continuously monitoring the length of yarn used to produce the fabric as the yarns are unwound from the beam section, and producing a length output signal corresponding thereto;

B. a second metering means for continuously monitoring the angular movement of the main shaft;

C. a metering means convertor connected to the second metering means for transforming the output of the second metering means to a continuous target output signal related to a desired yarn runner-length;

D. an error monitoring means connected to the output signals of the first metering means and the convertor for producing an error signal related to their difference; and E. a means for adjusting the angular velocity of the beam section in response to the error signal, whereby the length of yarn unwound from the beam section will approximate the desired runner-length.

2. A yarn runner-length controller for knitting machines as defined in claim 1, wherein the error monitoring means accumulates said error signals.

3. A yarn runner-length controller as defined in claim 2, further comprising error sampling means for sampling and updating the accumulated error signals.

4. A yarn runner-length controller as defined in claim 3, wherein the means for adjusting the beam section's angular velocity is activated when the sampled accumulated and updated error is nonzero, and is deactivated when said accumulated and updated error is zero.

5. A yarn runner-length controller as defined in claim 4, wherein the error sampling means incorporates means for monitoring said adjusting means, whereby the sampled error magnitude is reduced to zero.

6. A yarn runner-length controller as defined in claim 1, wherein the first and second metering means are encoders generating pulse information.

7. A yarn runner-length controller as defined in claim 1, wherein the error monitoring means generates a digitized error signal.

8. A yarn runner-length controller as defined in claim 1, wherein said angular velocity adjusting means in inhibited during intermittent knitting operation in which the beam section is periodically stopped.

9. A yarn runner-length controller as defined in claim 1, wherein said angular velocity adjusting means is inhibited during the shorter time duration partial runner-length of a two speed knitting operation.

10. A yarn runner length controller as defined in claim 1, wherein at least one of said signals is transferred to at least one interconnected external device.

11. A control apparatus for controlling the runner-length of filaments unwound from a beam section of a knitting machine comprising:

A. a first measuring device communicating with at least one filament of the beam section for continuously measuring the length of filament unwound from the beam section and generating a filament length output signal corresponding to said length;

B. a second measuring device coupled to the main shaft generating a continuous shaft signal related to the angular movement of said shaft;

C. a signal transforming device connected to receive said shaft signal from said second measuring device and generating a continuous target output signal corresponding to a desired runner-length and compatible with the length output signal of the first measuring device;

D. an error measuring device connected to receive the output signals of the first measuring device and the signal transforming device and generating in response thereto an error output signal related to the difference between the output signals of said measuring device and said transforming device; said error output signal resettable to a first predetermined value;

E. an error sampling device communicating with the error measuring device, periodically sampling the error output signal and causing the resetting of said error measuring device output signal;

F. a controlled drive device communicating with the error sampling device and generating a control signal in response to the sampled error output signal; and G. a beam section angular movement adjusting mechanism connected to be controlled by the output of the control drive device whereby the angular movement of the beam section is adjusted in a manner to cause the length output signal to approximate the target output signal of the transforming device.

12. A control apparatus for controlling the runner-length of filaments unwound from a beam section of a knitting machine as defined in claim 11, wherein the error measuring device in producing said error output signal algebraically sums the difference between the output signals of the measuring device and the transforming device; whereby said algebraically summed error output signal is reset to a predetermined value after it is sampled by the error sampling device.

13. A control apparatus for controlling the runner-length of filaments as defined in claim 12, wherein the control drive device incorporates clocking means that activate the generation of the control signal when the sampled error output signal is nonzero.

14. A control apparatus for controlling the runner-length of filaments as defined in claim 13, wherein said error sampling device incorporates means for receiving information from the control drive device regarding the generated control signal; whereby the sampled error output signal is reduced to a zero value prior to the next sampling of the error sampling device.

15. A control apparatus for controlling the runner-length of filaments as defined in claim 11, wherein said first measuring device and said second measuring device generate pulse information.

16. A control apparatus for controlling the runner-length of filaments as defined in claim 11, wherein said error measuring device and said error sampling device incorporate means for generating digitized signals.

17. A control apparatus for controlling the runner-length of filaments as defined in claim 11, wherein said control drive device incorporates means for generating a pulsed control signal.

18. A control apparatus for controlling the runner-length of filaments as defined in claim 11, wherein said beam section angular movement adjusting mechanism incorporates a stepping motor.

19. A control apparatus for controlling the runner-length of filaments as defined in claim 11, further comprising an error display device communicating with the output signals of the first measuring device and the signals transforming device for indicating the difference between the first measuring device and the signal transforming device.

20. A control apparatus for controlling the runner-length of filaments as defined in claim 19, wherein the error display is reset to zero when the accumulated signal of the second measuring device reaches a predetermined value.

21. A control apparatus for controlling the runner-length of filaments as defined in claim 11, further comprising a display device communicating with the signal transforming device and the first measuring device for indicating the actual runner-length.

22. A control apparatus for controlling the runner-length of filaments as defined in claim 11, further comprising a fail-safe device communicating with the error measuring device for terminating the knitting operation when the error output signal is greater than a predetermined value.

23. A control apparatus for controlling the runner-length of filaments as defined in claim 11, wherein said beam section angular movement adjusting mechanism is inhibited during intermittent knitting operations in which the beam section is periodically stopped.

24. A control apparatus for controlling the runner-length of filaments as defined in claim 11, wherein said beam section angular movement adjusting mechanism is inhibited during the shorter time duration partial runner-length of a two speed knitting operation.

25. A control apparatus for controlling the runner-length of filaments as defined in claim 11, wherein at least one of said signals is transferred to at least one interconnected external device.

26. A yarn runner-length controller for knitting machines having a main shaft and at least one beam section comprising:

A. a first metering means for continuously monitoring the length of yarn unwound from a beam section;

B. a second metering means for continuously monitoring the angular velocity of the main shaft;

C. an adjustable metering means convertor communicating with the second metering means for transforming the output of said means to a continuous target output signal related to a desired yarn runner-length;

D. an error monitoring means communicating with the outputs of the first metering means and the metering means convertor for producing an error signal related to their difference;

E. an error sampling means communicating with the error monitoring means for sampling the error signal and for resetting the error monitoring means to a predetermined value;

F. a beam section angular velocity adjusting means communicating with the error sampling means for adjusting the beam section's angular velocity when the sampled error signal has a value different than a predetermined value; and G. means communicating with the error sampling means for reducing the sampled error signal to said predetermined value.

27. A method for controlling the runner-length of filaments used in knitting machines having a main shaft and at least one beam section comprising the steps of:

A. continuously measuring the length of yarn unwinding from the beam section and generating a length signal related thereto;

B. continuously measuring the rotational movement of the main shaft and generating a signal related thereto;

C. transforming the measured rotational movement signal to a continuous target signal representing a desired runner-length for the filament;

D. comparing the measured length of the unwinding yarn to the desired runner-length target signal and generating an error signal related to their difference;

E. accumulating the error signal;

F periodically sampling the accumulated error signal;

G. resetting the accumulated error signal being accumulated at Step E to a predetermined value after said accumulated error signal is sampled;

H. increasing the angular velocity of the beam section when the sampled accumulated error signal is less than the predetermined value until the sampled error signal is adjusted to said predetermined value;

I. decreasing the angular velocity of the beam section when the sampled accumulated error signal is greater than the predetermined value until the sampled error signal is adjusted to said predetermined value;

J. maintaining the angular velocity of the beam section when the sampled accumulated error signal is equal to the predetermined value; and K. adjusting the sampled accumulated error signal toward the predetermined value in response to the increasing or decreasing of the beam section angular velocity.

28. A method of controlling the runner-length of yarn used in knitting machines as defined in claim 27, further comprising the step of:

J. terminating the knitting machine operation when the error signal is at least equal to a second predetermined value.

29. A method of controlling the runner-length of yarn used in knitting machines as defined in claim 27, wherein the magnitude of the sampled accumulated error signal is reduced to the predetermined value prior to the next periodic sampling of the accumulated error signal.

30. A method of controlling the runner-length of yarn used in knitting machines as defined in claim 27, further comprising the step of:

J. visually displaying the error signal.

31. A method of controlling the runner-length of yarn used in knitting machines as defined in claim 27, wherein the visual display is reset to zero when the signal representing the rotational movement of the main shaft reaches a predetermined value.

32. A method of controlling the runner-length of yarn used in knitting machines as defined in claim 27, further comprising the steps of:

J. algebraically adding the error signal;

K. visually displaying a number corresponding to said algebraic sum; and

L. resetting said algebraic sum to zero when the target signal equals a third predetermined value.

33. A method of controlling the runner-length of yarn used in knitting machines as defined in claim 27, wherein the increasing and decreasing of the angular velocity of the beam section is inhibited during intermittent knitting operations in which the beam section is periodically stopped.

34. A method of controlling the runner-length of yarn used in knitting machines as defined in claim 27, wherein the increasing and decreasing of the angular velocity of the beam section is inhibited during the shorter time duration partial runner-length of a two speed knitting operation.

35. A method of controlling the runner-length of yarn used in knitting machines as defined in claim 27, wherein at least one of said signals is transferred to at least one interconnected external device.

36. A yarn runner-length controller for knitting machines having a main shaft and at least one beam section comprising:

A. a first metering means for continuously monitoring the length of yarn used to produce fabric as the yarns are unwound from the beam section, producing a length output signal corresponding hereto;

B. a second metering means for continuously monitoring the angular movement of the main shaft;

C. a metering means convertor connected to the second metering means for transforming the output of the second metering means to a continuous target output signal related to a desired yarn runner-length;

D. counting means for continuously algebraically computing a momentary error signal corresponding to the difference between the outputs of the first metering means and the metering means convertor;

E. sampling means for repetitiously retrieving after a fixed interval of time the momentary error signal of the counting means and substantially simultaneously resetting said counting means error signal to a predetermined value while said counting means continues said algebraic computing of a new momentary error signal; and F. means for adjusting the angular velocity of the beam section in response to the sampled momentary error signal.

37. A yarn runner-length controller as defined in claim 36, wherein the means for adjusting the beam section's angular velocity is activated when the sampled momentary error signal is not equal to said predetermined value, and is de-activated when the momentary error signal is equal to said predetermined value.

38. A yarn runner-length controller as defined in claim 37, wherein the sampling means further incorporates means for monitoring the angular velocity adjusting means whereby the sampled error signal is reduced to said predetermined value prior to the next sampling of the new momentary error signal generated by the counting means.

39. A yarn runner-length controller as defined in claim 36 wherein the first and second metering means are encoders generating pulse information.

40. A yarn runner-length controller as defined in claim 36, wherein the counting means generates a digitized momentary error signal.

41. A yarn runner-length controller as defined in claim 36, wherein the angular velocity adjusting means is inhibited during intermittent operations in which the beam section is periodically stopped.

42. A yarn runner-length controller as defined in claim 36, wherein said angular velocity adjusting means is inhibited during the shorter time duration partial runner-length of a two-speed knitting operation.

43. A yarn runner-length controller for knitting machines having a main shaft and at least one beam section comprising:

A. a first metering means for continuously monitoring the length of yarn used to produce fabric as yarns are unwound from the beam section, and for producing a length output signal series of electronic pulses corresponding thereto;

B. a second metering means for continuously monitoring the angular movement of the main shaft and for producing an angular movement output signal series of electronic pulses corresponding thereto;

C. a metering means convertor connected to the second metering means output signal for transforming this output to a target output signal series of electronic pulses related to a desired yarn runner-length;

D. counting means for continuously algebraically computing a momentary digitized error signal corresponding to the difference between the outputs of the first metering means and the metering means convertor;

E. sampling means for repetitiously retrieving after a fixed interval of time the momentary digitized error signal of the counting means and substantially simultaneously resetting said digitized counting means error signal to a predetermined value while said counting means continues said algebraic computing of a new momentary digitized error signal; and F. means for adjusting the angular velocity of the beam section in response to the sampled momentary digitized error signal so as to increase the beam section's angular velocity if the momentary error signal is less than the predetermined value, to decrease the beam section's angular velocity if the momentary error signal is greater than the predetermined value, and to maintain the beam section's angular velocity if the momentary error signal is equal to the predetermined value.

44. A yarn runner-length controller as defined in claim 43, wherein said metering means convertor is manually selectable for transforming the second metering means output signal to a target output signal related to a desired yarn runner-length.

45. A yarn runner-length controller as defined in claim 43, wherein said means for adjusting the angular velocity of the beam section incorporates a stepping motor responsive to the sampled momentary digitized error signal.

46. A yarn runner-length controller as defined in claim 43, wherein the angular velocity adjusting means generates periodic clocking pulses if the instantaneous value of the sampled error signal is not equal to said predetermined value, and wherein the sampling means further incorporates means for monitoring said angular velocity adjusting means and for reducing the instantaneous value of the sampled digitized error signal an amount corresponding to the number of periodic clocking pulses, whereby the sampled digitized error signal is reduced to said predetermined value prior to the next sampling by the sampling means of the new momentary digitized error signal.

47. A yarn runner-length controller as defined in claim 1, wherein said metering means convertor is manually selectable for transforming the second metering means output signal to a target output signal related to a desired runner-length.

48. A control apparatus as defined in claim 11, wherein said signal transforming device is manually selectable for transforming the second measuring device shaft signal to a target output signal related to a desired runner-length.

* * * * *

UNITED STATES PATENT AND TRADEMARK OFFICE

CERTIFICATE OF CORRECTION

PATENT NO. : 3,961,500

DATED : June 8, 1976

INVENTOR(S) : Robert L. Braley, Mircea Tenenbaum, Edward J.Milano

It is certified that error appears in the above-identified patent and that said Letters Patent are hereby corrected as shown below:

Column 1, Line 46, cancel "relay" and substitute therefor --rely--

Column 2, Line 34, cancel "elminiating" and substitute therefor --eliminating--

Column 5, Line 46, cancel "acutal" and substitute therefor --actual--

Column 8, Line 11, cancel "shapersynchronizer" and substitute therefor --shaper-synchronizer--

Column 8, Line 55, cancel "shapersynchronizer" and substitute therefor --shaper-synchronizer--

Column 9, Line 21, cancel "shapersynchronizer" and substitute therefor --shaper-synchronizer--

Column 9, line 34, cancel "runnerlength" and substitute therefor --runner-length--

Column 10, line 47, insert "an" before "amount"

Column 13, line 19, cancel "acutal" and substitute therefor --actual--

Column 14, line 14, cancel "runner-lengthh" and substitute therefor --runner-length--

Column 14, Line 30, cancel "kintting" and substitute therefor --knitting--

UNITED STATES PATENT OFFICE

CERTIFICATE OF CORRECTION

PATENT NO. : 3,961,500

DATED : June 8, 1976

INVENTOR(S) : Robert L. Braley, Mircea Tenenbaum, Edward J.Milano

It is certified that error appears in the above-identified patent and that said Letters Patent are hereby corrected as shown below:

Column 16, Line 16, cancel "wrap" and substitute therefor --warp--

Column 17, Line 16, after "Instruments" cancel "." and substitute therefor --,--

Column 18, line 2, add a period after "132"

Column 18, line 54, cancel "drives" and substitute therefor --drive--

Column 19, Line 10, insert --of-- after "be"

Column 20, line 5, cancel "in" and substitute therefor --is--

Column 20, line 12, cancel "runner length" and substitute therefor --runner-length--

Column 21, line 28, cancel "signals" and substitute therefor --signal--

Column 22, line 39, add a period after "F"

Signed and Sealed this

Sixteenth Day of November 1976

[SEAL]

*Attest:*

RUTH C. MASON
*Attesting Officer*

C. MARSHALL DANN
*Commissioner of Patents and Trademarks*